United States Patent [19]

Shaw et al.

[11] 4,087,122

[45] May 2, 1978

[54] FASTENING MECHANISM FOR DOORS

[75] Inventors: Leslie Ralph Shaw, Wednesbury; Barry Stanley Morris, Walsall, both of England

[73] Assignee: The Bloxwich Lock and Stamping Company Limited, Walsall, England

[21] Appl. No.: 713,229

[22] Filed: Aug. 10, 1976

[30] Foreign Application Priority Data

Sep. 12, 1975 United Kingdom ..... 37529/75

[51] Int. Cl.[2] ..... E05C 3/04

[52] U.S. Cl. ..... 292/218; 292/241; 292/DIG. 32

[58] Field of Search ..... 292/218, DIG. 32, 241, 292/67

[56] References Cited

U.S. PATENT DOCUMENTS

| | | | |
|---|---|---|---|
| 3,329,456 | 7/1967 | Olander | 292/218 |
| 3,347,583 | 10/1967 | Hallberg | 292/218 X |
| 3,544,145 | 12/1970 | Cerutti | 292/218 X |
| 3,549,185 | 12/1970 | Lynn | 292/218 |
| 3,572,794 | 3/1971 | Pastva | 292/218 |
| 3,653,704 | 4/1972 | Hawkins | 292/218 |
| 3,661,412 | 5/1972 | Morris | 292/218 |
| 3,664,695 | 5/1972 | Sickel | 292/DIG. 32 |

FOREIGN PATENT DOCUMENTS

| | | | |
|---|---|---|---|
| 2,510,554 | 10/1975 | Germany | 292/218 |
| 1,344,181 | 1/1974 | United Kingdom | 292/218 |

*Primary Examiner*—Roy D. Frazier
*Assistant Examiner*—Rodney H. Bonck
*Attorney, Agent, or Firm*—Scrivener, Parker, Scrivener & Clarke

[57] ABSTRACT

In a fastening for a door of a vehicle or freight container an operating bar mounted for angular movement about its axis on the door carries on at least one end a fastening member for engagement with a keeper on a door frame, and the said member has on one side of its axis a radially projecting fork for co-operation with one overhung lug projecting forwardly from the keeper, on the other side a radially projecting part for co-operation with a second forward projection on the keeper, and a radially projecting rib which, in the fully fastened condition of the mechanism, is received in a groove in the keeper between said forward projections.

1 Claim, 20 Drawing Figures

FASTENING MECHANISM FOR DOORS

This invention relates to improvements in fastenings mechanism for doors of vehicles and of freight containers for the carriage of goods by road, rail or sea.

Our invention is concerned with door fastening mechanism of the kind in which an operating bar adapted to be mounted in bearings on the door for angular movement about its axis carries on one or each end a fastening member for co-operation with a keeper having a base or mounting plate adapted to be mounted on the door frame to which the door is hinged along one vertical edge, the bar being movable angularly by a handle which can be positively locked in a position corresponding to the full engagement of the fastening member or each fastening member with its keeper.

According to our invention, in fastening mechanism of that kind the fastening member of each fastening member incorporates on one side of the axis of the operating bar a radially projecting fork of which the limbs are adapted to engage under laterally extending parts of an overhung lug extending forwardly from the base or mounting plate of a keeper, substantially flat surfaces on the free ends of the limbs and a complementary surface of the overhung portion of the lug with which they engage in the fully fastened position of the fastening member being inclined at an acute angle to the plane of the door, and on the opposite side of the operating bar the fastening member incorporates a radially projecting part cooperating with a forward projection on the base of the keeper to restrain relative movement between the fastening member and the keeper in a direction parallel to the axis of the operating bar.

The radially projecting part of the fastening member on the opposite side from the fork may comprise a second fork, which, in the fully fastened condition of the mechanism, engages over a forwardly projecting boss on the keeper spaced from the overhung lug.

The co-operating surfaces of the limbs of this second fork and of the boss on the keeper may be complementarily inclined to produce a wedging anti-rack action as the fastening member moves into the fully fastened position.

Alternatively the radially projecting part of the fastening member may comprise a finger adapted to engage in a recess in a boss projecting forwardly from the base of the keeper, and the co-operating surfaces of the finger and recess may be complementarily inclined to produce a wedging action.

In either form of the mechanism a rib may be formed on the side of the fastening member which is nearest to the base of the keeper in the fully fastened position, and as the fastening member is rotated into that position the rib engages in a complementary groove in the base of the keeper to provide an anti-rack engagement between the cam and the keeper. The cross-sections of the rib and the groove may be such as to produce a wedging action.

Two forms of our improved fastening mechanism are illustrated by way of example in the accompanying drawings, in which.

Figure 1:
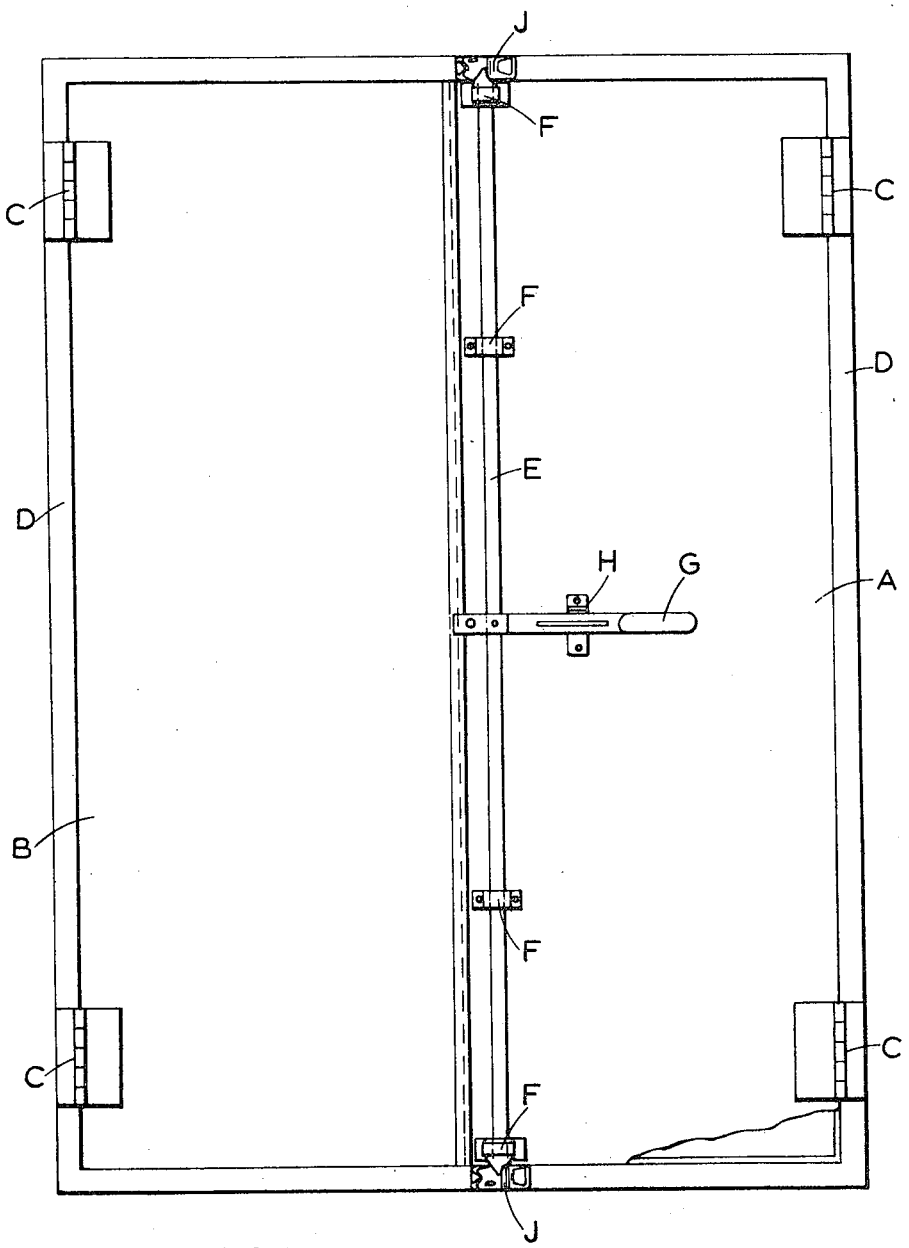
FIG. 1 is an end elevation of the door end of a freight container with the door in the closed position and showing the fastening mechanism engaged.
Figure 2:
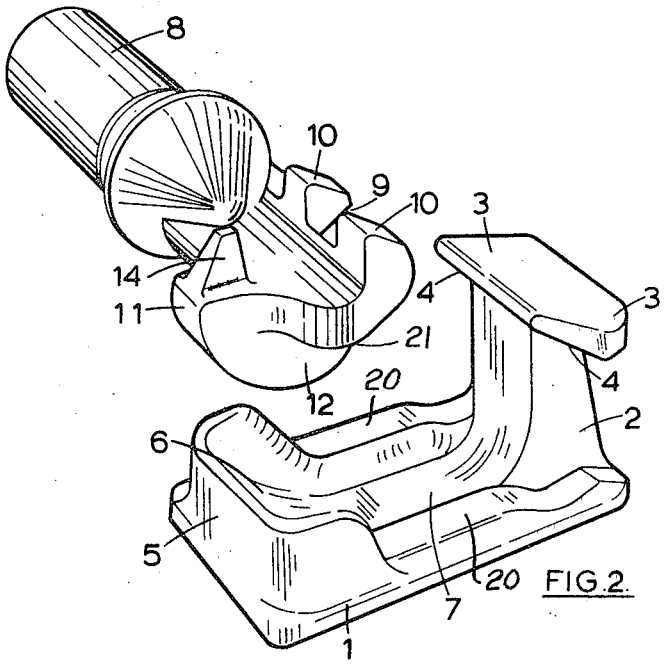
FIG. 2 is a perspective view of the fastening member and keeper of one form.
Figure 3:
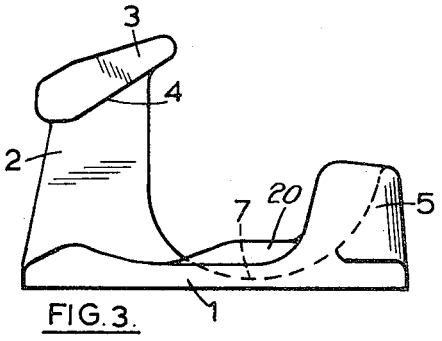
FIG. 3 is a side elevation of the keeper.
Figure 5:
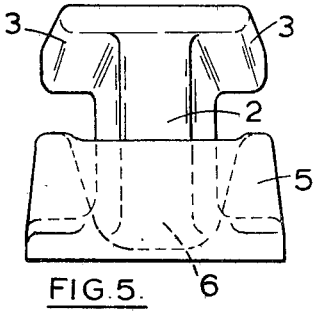
FIG. 5 is an end view of the keeper.
Figure 4:
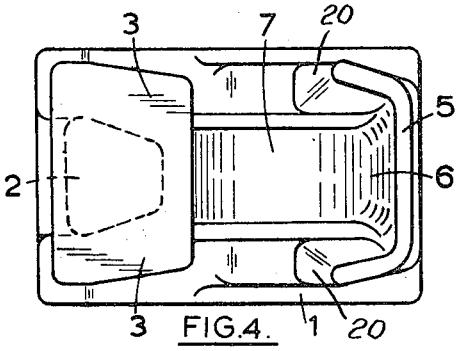
FIG. 4 is a plan of the keeper.
Figure 6:
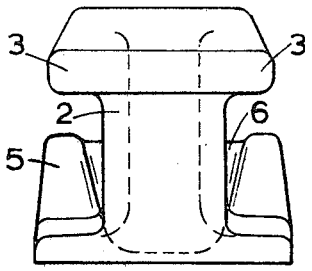
FIG. 6 is a view from the other end.
Figure 7:
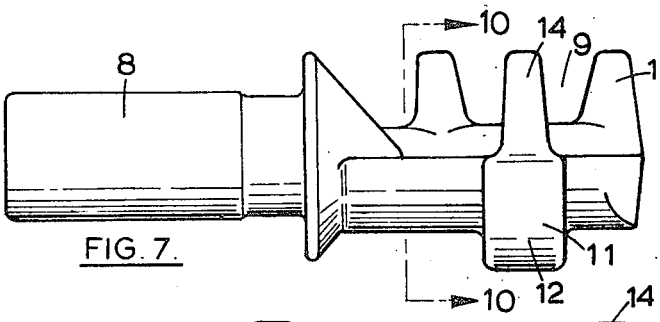
FIG. 7 is a side elevation of the fastening member.
Figure 10:
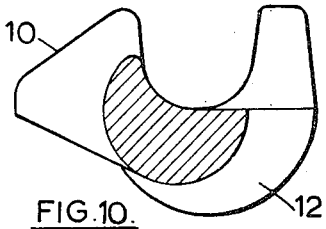
FIG. 10 is a cross-section on the line 10—10 of FIG. 7.
Figure 9:
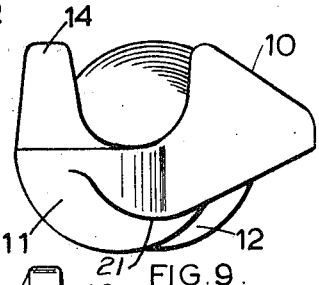
FIG. 9 is an end view.
Figure 8:
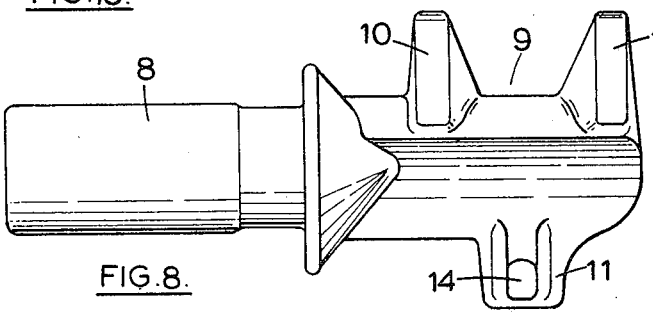
FIG. 8 is a plan view.

The container shown in FIG. 1 is provided with a door formed in two co-operating halves A, B each mounted by means of hinges C on the vertical side members D of the container. A vertical operating bar E is mounted in spaced bearings F on the half door B for angular movement about its axis. The angular movement of the bar is effected by a handle G welded or otherwise secured to the bar. In the closed position of the door the handle is received in a fitting H on the half door A and any convenient means (not shown) are provided for locking the handle in the fitting H.

Each end of the bar E carries a fastening member co-operating with keepers J secured to the top and bottom members of the door frame, the keepers and fastening members being described in detail below.

In the form of the mechanism shown in FIGS. 1 to 14 the keeper is a steel forging having a base 1 with a flat rear attachment face and is adapted to be welded or bolted to the frame of a container at the top or bottom of the door opening.

Adjacent to one end of the base there is a forwardly projecting overhung lug comprising a shank 2 on the free end of which are opposed laterally extending parts 3,3 of which the under surfaces 4,4 are flat and are inclined at an acute angle to the attachment face of the base.

Adjacent to the other end of the base there is a forwardly projecting boss 5 in which there is a recess 6 facing the overhung lug. Between the boss and the lug there is a groove 7 in the base extending from the boss 5 substantially up to the shank 2 of the lug. The groove lies between parallel transversely spaced raised portions 20 of the base which extend from the boss towards the lug, these raised portions having a function which is described below.

The fastening member is also a steel forging and has a cylindrical shank 8 adapted to be received in and welded to a steel tube (not shown) forming an operating bar which is rotatably mounted in the usual way in bearings on the door of the container. The fastening member itself incorporates on one side of the axis a radially projecting fork 9, the free ends of the limbs of which terminate in flat inclined faces 10,10 for co-operation with the flat surfaces 4,4 of the overhung lug on the keeper.

On the opposite side of the axis the fastening member incorporates a radially projecting finger 11 adapted to engage in the recess 6 in the keeper.

On the side of the fastening member which is next to the base in the fastened condition of the mechanism there is a projecting rib 12 extending from the finger 11 adapted to engage in the groove 7 in the base.

On opposite sides of the rib 12 there are radiussed surfaces 21 described about the axis of the operating bar at the inner ends of the fork limbs for co-operation with the raised portions 20 in the base of the keeper. In the first part of the closing movement of the door the fastening member enters between the overhung lug and the boss on the keeper, the limbs of the fork being at that time substantially at right angles to the base of the keeper.

As the closing movement of the door continues the ends of the fork limbs strike the raised portion 20 on the base of the keeper and as at the same time the fastening member is being rotated by the operating bar the ends of the fork limbs slide along these raised portions and the limbs swing round and up under the projecting part 3 of the overhung lug on the keeper until the parts reach the final fully fastened position shown in FIGS. 11 to 15.

In this position the limbs of the fork are engaged under the overhung lug with their co-operating flat surfaces in contact and at an acute angle to the base of the keeper, the finger 11 is engaged in the recess 6, and the rib 12 is engaged in the groove 7 in the base.

Figure 14:
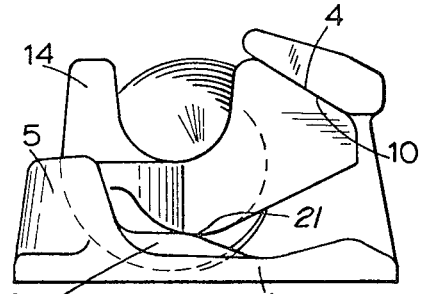
FIG. 14 is an end view.
Figure 15:
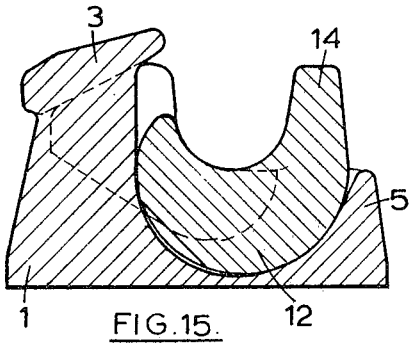
FIG. 15 is a section on the line 15—15 of FIG. 11.

It will be appreciated from FIG. 14 that in the fully fastened condition of the mechanism the raised portions 20 of the base of the keeper act as fulcrums for the radiussed portions 21 on the fastening member to force the inclined surfaces 10 on the ends of the fork limbs into effective locking engagement with the complementary under-surfaces of the overhung lug on the keeper.

Figure 11:
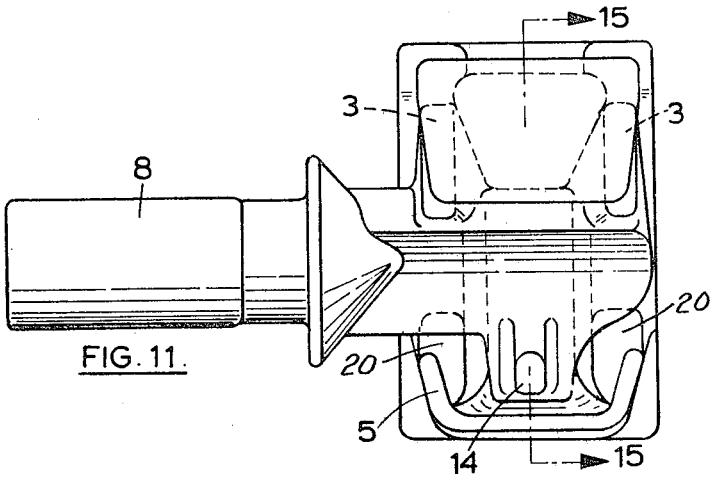
FIG. 11 is a plan view of the fastening member and keeper in full fastening engagement.
Figure 12:
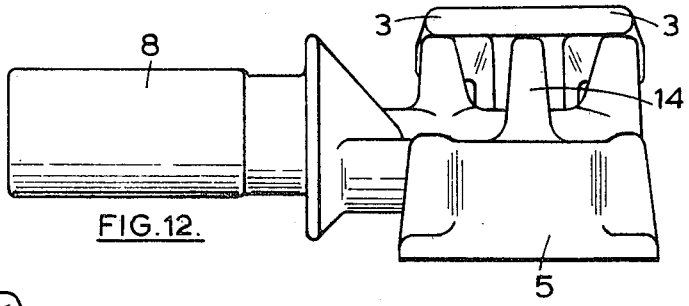
FIG. 12 is a side elevation of the assembled parts.
Figure 13:
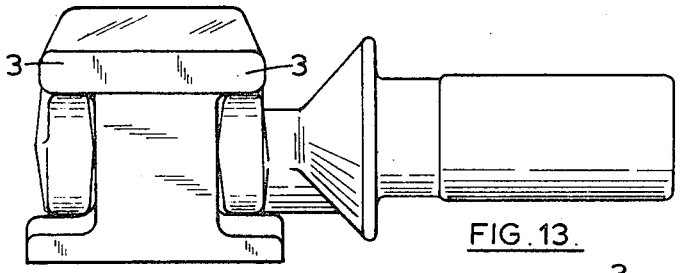
FIG. 13 is a side elevation from the opposite side.

The stem of the overhung lug is of truncated wedge shape in cross-section and the co-operating inner surfaces of the fork limbs are complementarily inclined as shown more particularly in FIG. 11.

The co-operating surfaces of the rib 12 and the groove 7, and of the finger 11 and the recess 6, are also complementarily inclined to produce a wedging action in the fully fastened position of the mechanism which effectively prevents relative movement between the fastening member and the keeper in a direction parallel to the axis of the operating bar and so resists racking of the container under distorting forces. On the finger 11 of the fastening member there is a forward projection 14 which, as the operating bar is rotated in the opening movement of the fastening is adapted to bear on the outer surface of the overhung lug on the keeper to assist in the opening movement of the door.

Figure 16:
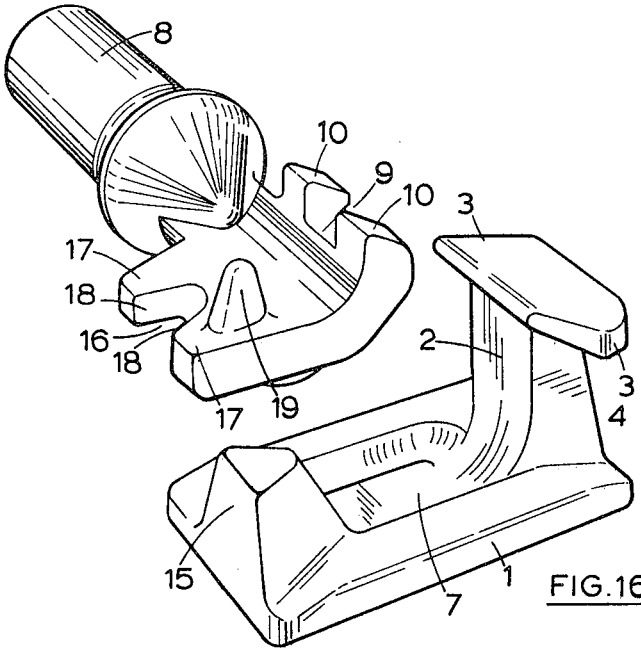
FIG. 16 is a perspective view of the fastening member and keeper of another form.
Figure 17:
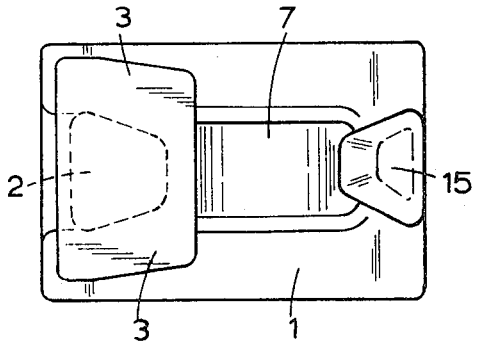
FIG. 17 is a plan of the keeper.
Figure 18:
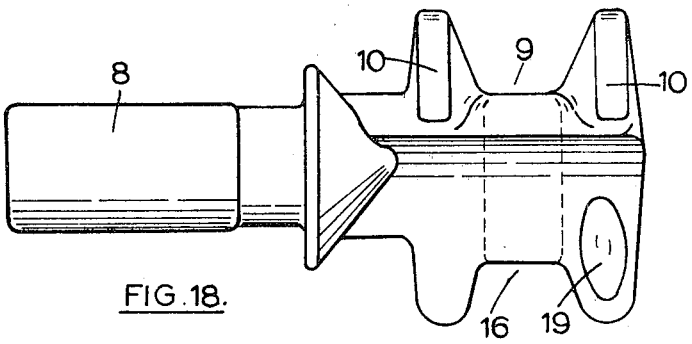
FIG. 18 is a plan of the fastening member.
Figure 19:
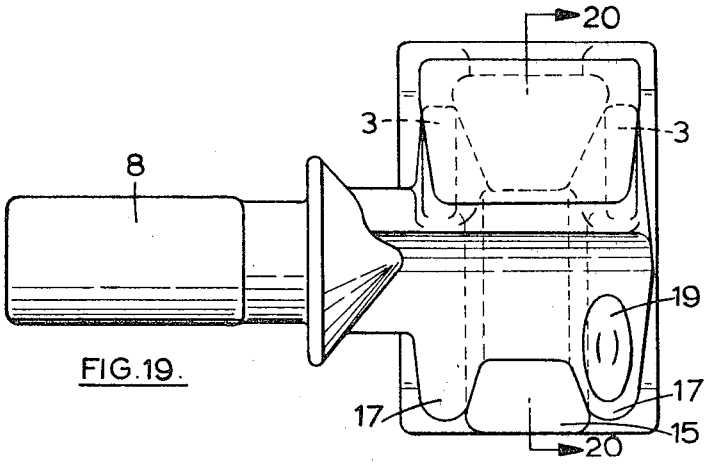
FIG. 19 is a plan of the fastening member and keeper in full fastening engagement.
Figure 20:
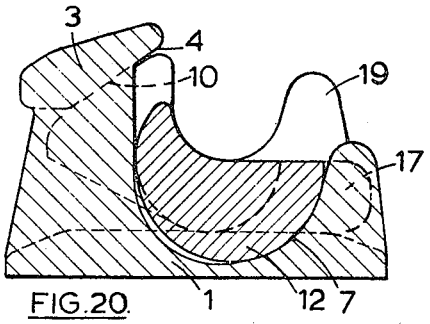
FIG. 20 is a section on the line 20—20 of FIG. 19.

A modified form of fastening mechanism is shown in perspective in FIG. 16 and in detail in FIGS. 16 to 20.

The base of the keeper and the overhung lug on the keeper are the same as in the first form and the same reference numerals have been applied to them. However, in the keeper the boss 5 with its recess 6 have been replaced by a forwardly projecting boss 15 of tapering wedge cross-section in planes parallel to the attachment surface of the keeper.

For co-operation with the boss 15 the fastening member, instead of the finger 11, has a second fork 16 of which the limbs 17,17 in the fastened condition of the mechanism fit over the boss 15. The inner surfaces 18 of the fork limbs are inclined complementarily to the surfaces of the boss with which they engage to provide a wedging anti-rack action.

A forward projection 19 on one limb of the fork corresponds to the projection 14 in the first form and has the same function.

We claim:

1. Fastening mechanism for doors of vehicles and freight containers in which an operating bar mounted in bearings on a door for angular movement about its axis carries on at least one end a fastening member incorporating fastening elements extending from opposite sides of the bar for engagement with cooperating parts of two spaced projections extending forwardly from a keeper having a base or mounting plate adapted to be mounted on the top or bottom of the door frame to which the door is hinged along one vertical edge, wherein the mechanism comprises a keeper having a base for attachment to a door frame, a first integral forward projection on the base comprising a shank portion and a laterally extending head of which the surfaces facing the base are substantially flat and inclined at an acute angle to the base, a second integral forward projection on the base spaced from the first projection and incorporating a forwardly facing recess, a groove in the base extending from said second projection towards said first projection, and transversely spaced raised portions of the base on opposite sides of said groove intermediate said first and second projections, and a fastening member for cooperation with said keeper and angularly movable about an axis parallel to the plane of the door, said fastening member having on one side of its axis a fork of which the limbs are adapted to receive between them the shank of said first projection on the keeper and terminate in substantially flat inclined surfaces for engagement with the inclined surfaces on the head of said first projection on the keeper and having on the other side of its axis a radially projecting lug for engagement in the recess in said second projection on the keeper, and further having between said fork and said lug a radially projecting rib for engagement in said groove in the base of the keeper, the limbs of said fork having at their inner ends radiussed surfaces described about the axis of the operating bar on opposite sides of said rib, which surfaces cooperate, in the final part of the rotational locking movement of the fastening member, with said raised portions of the base of the keeper which act as fulcrums forcing the flat ends of the fork limbs into locking engagement with the flat inclined surfaces of the head of the first projection on the keeper in the fully fastened condition of the mechanism.

* * * * *